United States Patent [19]

Kolaska et al.

[11] 3,999,954

[45] Dec. 28, 1976

[54] HARD METAL BODY AND ITS METHOD OF MANUFACTURE

[75] Inventors: Johannes Kolaska, Bottrop; Norbert Fritz Reiter, Mettmann; Heinz Röttger, Hosel, all of Germany

[73] Assignee: Fried. Krupp Gesellschaft mit beschrankter Haftung, Essen

[22] Filed: July 9, 1975

[21] Appl. No.: 594,224

[30] Foreign Application Priority Data

July 26, 1974 Germany ..... 2435989

[52] U.S. Cl. ..... 29/182.7; 29/182.8; 148/126; 75/203; 75/204; 75/208 R

[51] Int. Cl.[2] ..... C22C 29/00

[58] Field of Search ..... 148/126; 29/182.7, 182.8; 75/203, 204, 208 R

[56] References Cited

UNITED STATES PATENTS

| | | | |
|---|---|---|---|
| 2,765,227 | 10/1956 | Goetzel et al. | 75/203 |
| 3,147,542 | 9/1964 | Boeckeler | 75/203 |
| 3,171,192 | 3/1965 | Ortner et al. | 75/203 |
| 3,647,576 | 3/1972 | Yamamura et al. | 75/203 |
| 3,736,107 | 5/1973 | Hale | 75/203 |

*Primary Examiner*—Brooks H. Hunt
*Attorney, Agent, or Firm*—Spencer & Kaye

[57] ABSTRACT

A wear-resistant hard metal body is provided including a core of a hard metal body and a surface coating of a hard material on the core. The core of hard metal body includes at least one of the binder metals iron, cobalt and nickel and at least one of the carbides of the elements titanium, zirconium, hafnium, vanadium, niobium, tantalum, chromium, molybdenum and tungsten. The surface coating of hard material contains at least one carbide, nitride, boride and/or oxide. The binder metal contained in the core of hard metal body is also contained in the surface coating of the hard material and originates from the core of hard metal body.

A method is provided for producing such wear-resistant hard metal bodies by subjecting a hard metal body comprising a core of hard metal body and a hard surface coating on the core to a pressure of between about $10^{-5}$ Torr and about 10 bar and a temperature between about 900° and about 1600° C for a period of time between about one minute and about 8 hours to diffuse binder metal from the core into the surface coating.

26 Claims, No Drawings

HARD METAL BODY AND ITS METHOD OF MANUFACTURE

BACKGROUND OF THE INVENTION

The present invention relates to a wear-resistant hard metal body and to a method for producing such a hard metal body.

It has long been known that hard metal bodies can be formed from at least one binder or bonding metal of iron, cobalt and nickel and at least one hard metal refractory carbide of at least one of the elements titanium, zirconium, hafnium, vanadium, niobium, tantalum, chromium, molybdenum and tungsten. The hard metal body generally is formed by uniting a powdered form of the hard metal carbide by compression with the binding metal, followed by sintering. During the sintering process, the product generally receives its final shape and dimensions and the resulting sintered product is a molded, shaped, hard metal body which often is referred to as a cemented carbide. The hard metal bodies possess great hardness and find wide application in metal turning and cutting tools which are hard enough to permit high turning and cutting speeds in rock or metal.

Increasing demands have been placed on hard metal bodies and there has been a continuing search to provide hard metal bodies having still greater wear resistance. To this end, there has been produced hard metal bodies comprising a core of a shaped, hard metal body formed from a hard metal carbide and bonding metal as described above and a surface coating of a hard material on the core. The surface coating of hard material has been made from such materials as carbides, nitrides, borides and/or oxides. Preferably, the surface coating has been made from titanium carbide.

Moreover, the surface coating can be made from all carbides, nitrides and borides of the Group IVa to VIa of the periodic system of elements, such as hafnium carbide, tungsten carbide, zirconium nitride, hafnium nitride, niobium nitride, tantalum nitride, titanium nitride, titanium boride, hafnium boride and tantalum boride. Further carbides which can be used are silicon carbide and boron carbide, and further nitrides which can be used as silicon nitride, boron nitride, aluminium nitride, and thorium nitride. An excellent hard material surface coating is also formed by the mixtures of carbides, nitrides and borides, such as titanium carbonitrides. As for oxides, aluminium oxide and zirconium oxide are preferably used, as well as magnesium oxide, beryllium oxide, thorium oxide, cerium oxide, titanium oxide, hafnium oxide or chromium oxide. The solid solutions of the afore-mentioned oxides, such as chromium oxide and aluminium oxide, as well as mixed oxides of the spinell type, such as magnesium aluminium oxide or magnesium chromium oxide are also used.

In addition to providing a surface coating of hard material on the core of hard metal body, intermediate layers have been provided between the core and surface coating. The main purpose of the intermediate layers is the equalization of stresses. Metals, such as cobalt, nickel and iron have proved particularly suitable for this, also precious metals, such as platinum. The intermediate layers can be applied to the hard metal body by electrodeposition. Intermediate layers can also be formed by the CVD process or one of the PVD processes.

Molded hard metal bodies having a core of a hard metal body and a surface coating of a hard material are known to be very hard at the surface and/or have a low tendency to heatweld. Workpieces made of such surface-coated molded hard metal bodies are therefore very wear-resistant. The surface coating of the hard material generally is formed in such a manner that carbides, nitrides, borides and oxides as well as their mixtures are deposited on the core of hard metal body during a separate process step. For example, deposition from the gaseous phase according to the chemical vapor deposition process is preferred method of forming a surface coating on a hard metal body.

Tools made of the known hard metal bodies coated on their surface with a hard material have the primary drawback that their use for turning and cutting operations is possible only within limits because the tools are subjected during this use to high impact stresses and strong alternating thermal stresses which often cause the surface coating of hard material to chip off which leads to premature failure of the tools. Hard surface coatings of a layer thickness of more than $20\mu$ have particularly poor adhesion to the underlying core of hard metal body. In practice, this means that only hard surface coatings having a layer thickness of between 5 to $10\mu$ can be used. Although the wear-resistance of a hard metal body having a surface coating of a hard material should increase with increasing layer thickness of the surface coating, hard surface coatings with a layer thickness of more than $20\mu$ cannot be used because under the alternating thermal stresses occurring during use in cutting and turning operations, they come off of their core of hard metal body, before they are worn out, due to lack of adhesion. Attempts have been made to overcome these drawbacks by providing metallic intermediate layers between the core and surface coating or a plurality of hard layers, but these attempts have not been entirely successful.

SUMMARY OF THE INVENTION

It is a primary object of the present invention to provide a hard metal body comprising a core of a hard metal body and a surface coating of a hard material on the core in which the surface coating has improved adhesion to the hard metal body core compared to known hard metal bodies having hard surface coatings.

Another object of the present invention is to provide a method for producing an improved hard metal body having a core of a hard metal body and a firmly adhering surface coating of a hard material on the core.

Additional objects and advantages of the present invention will be set forth in part in the description which follows and in part will be obvious from the description or can be learned by practice of the invention. The objects and advantages are achieved by means of the compositions, methods, instrumentalities and combinations particularly pointed out in the appended claims.

To achieve the foregoing objects, and in accordance with its purpose, the present invention, as embodied and broadly described, provides a wear-resistant hard metal body comprising (1) a core of hard metal body made from at least one of the binder metals of iron, cobalt and nickel and at least one of the carbides of the elements titanium, zirconium, hafnium, vanadium, niobium, tantalum, chromium, molybdenum and tungsten and(2) a surface coating of a hard material on the core, the hard material being at least one carbide, nitride, boride or oxide, with the surface coating containing a binder metal contained in the core of hard metal body and originating from the core of hard metal body.

The hard material of the surface coating is that used in the past and is at least one carbide, nitride, boride or oxide.

The concentration of the binder metal in the surface coating can decrease from its unexposed surface toward its exposed surface or can be constant. The concentration of the binder metal in the surface coating depends on the length of the treatment that is used to introduce the binding metal into the surface coating, as explained in greater detail hereafter, with treatments lasting for a relatively short period of time bringing about a concentration gradient and treatments lasting for a longer period of time bringing about a constant concentration.

In one embodiment of the invention, at least one intermediate layer can be provided between the core and surface coating and these intermediate layers can contain a binding metal of iron, cobalt or nickel. In this embodiment of the invention, the binding metal in the surface coating can originate solely from the intermediate layer or can originate from both the core and intermediate layer.

In another aspect of the present invention, a method is provided for producing the hard metal bodies of the present invention in which a hard metal body comprising (1) a core of a hard metal body made from at least one of the binder metals of iron, cobalt and nickel and at least one of the carbides of the elements titanium, zirconium, hafnium, vanadium, niobium, tantalum, chromium, molybdenum and tungsten and (2) a surface coating of a hard material on the core, the hard material being at least one carbide, nitride, boride, or oxide is subjected for a period of time between about one minute and about 8 hours, to a pressure of between about $10^{-5}$ Torr to about 10 bar, and a temperature between about 900° and about 1600° C to diffuse binder metal from the core into the surface coating.

Preferably, the heat and pressure treatment of the present invention is carried out for 1 to 60 minutes at a pressure of $10^{-3}$ Torr to 10 Torr and a temperature of 1200° to 1400° C. In many cases it is advantageous for the pressure-temperature treatment of the hard metal body to be effected in the presence of a protective or inert gas, such as hydrogen, nitrogen, helium argon, or mixtures thereof.

The above heat and pressure treatment can be applied to hard metal bodies having at least one intermediate layer between the core and surface coating. When the intermediate layer contains a binder metal or iron, cobalt or nickel, the binder metal that diffuses into the surface coating can originate from the intermediate layer or can originate from both the intermediate layer and core. The intermediate layer or layers are those that have been used in the past.

The concentration of the binder metals in the hard material layer is smaller than or equal to the concentration of the binder metals in the core of the hard metal body. To be suitable for machining, the hard metal body has a binder metal content of 5 to 12% by weight.

The best results are obtained if after the pressure-temperature treatment according to the invention the binder metals diffuse into the first third of the hard material layer, with the concentration of the binder metals in the hard material layer decreasing steadily from the concentration of the binder metals in the core, i.e. from about 5 to 12% by weight to 0% by weight. Particularly favourable properties are obtained if a hard metal body coated with a hard metal layer, such as titanium carbide, is treated at a temperature of 1250° C and a pressure of $10^{-1}$ Torr for a period of 10 minutes.

By raising the temperature to 1350° C and extending the treatment time to 30 minutes, the concentration gradient of the binder metals in the hard material layer is completely eliminated. The hard material layer then contains as much binder metal as the core of the hard metal body, namely 5 to 12% by weight, depending on the nature of the hard metal body.

The hard metal bodies configured and produced according to the present invention have the advantage compared to the known hard metal bodies coated with a surface coating of a hard material that the hard surface coating of the present invention has much better adhesion to the core of hard metal body. This desirable property is obtained because the binder metals diffuse during the pressure-temperature treatment from the core of hard metal body and/or the intermediate layers into the hard surface coating so that a firm bond is produced between the two phases. The improved adhesion of the hard surface coating makes it possible to increase the thickness of the surface coating, without causing the thicker surface coating to chip off prematurely. The thick, well-adhering hard surface coatings of the present invention result in a substantially extended period of use for the tools made of the hard metal bodies according to the present invention. It has also been found that the double carbide layer (eta zone) which is often present in the known hard-surface coated hard metal bodies is avoided by the pressure-temperature treatment of the present invention.

Depending on the deposition process used, the thickness of the hard material surface layer can be increased to about 100 $\mu$m, the most suitable range being around a layer thickness of about 20 $\mu$m.

DESCRIPTION OF THE PREFERRED EMBODIMENT

The production, structure and properties of hard metal bodies produced in accordance with the present invention will now be explained in detail with the aid of two embodiments.

EXAMPLE 1

An already formed shaped hard metal body in the form of a turning tool and comprised of 70% WC, 20% TiC + TaC and 10% Co is used as a core and is coated in the gaseous phase according to a known process to produce a surface coating of a hard material on the core. The hard surface coating has a layer thickness of 5$\mu$ and consists of TiC. This coated hard metal body, which is part of the state of the art, is subjected, in accordance with the present invention, to a pressure of $10^{-3}$ Torr and a temperature of 1350° C for one hour in a vacuum furnace. This heat and pressure treatment causes cobalt to diffuse from the hard metal body core into the TiC surface coating. After the pressure-temperature treatment, the concentration of cobalt in the TiC surface coating is greater at the inside of the coating than at the outside.

The properties of the resulting turning tool made in accordance with the present invention are measured by means of a turning experiment and compared with the properties of a turning tool coated according to a known process. The turning tool coated according to the known process was identical with that produced according to the present invention except that it was not subjected to the heat and pressure treatment of the present invention.

In the turning experiment, four rods of C45 KN steel each having a diameter of 40 mm and a length of 60 mm were clamped in an axially parallel manner in an apparatus having a hole diameter of 190 mm. The rods were faced from the inside toward the outside at a cutting speed of $v = 100$ m/min; a cutting depth of $a =$ 2 mm; and an advance of $s = 0.4$ to 0.8 mm/revolution.

The known turning tool was able to produce 2240 cuts before it could no longer be used whereas the turning tool of the present invention produced 15,750 cuts before it could no longer be used.

EXAMPLE 2

An already formed, shaped hard metal body in the form of a turning plate and consisting of 80% WC, 13% TiC + TaC and 70% Co is used as a core and is coated in the gaseous phase according to known process to produce a surface coating of a hard material on the core. The hard surface coating has a layer thickness of $5\mu$ and consists of TiC. This coated hard metal body, produced in accordance with the state of the art, is subjected, in accordance with the present invention, to a pressure of $10^{-1}$ Torr and a temperature of 1350° C for a period of 1 hour in a vacuum furnace. During this heat and pressure treatment, cobalt diffused into the TiC layer. The cobalt concentration in the TiC surface coating is greater at the inside of the surface coating than at the outside.

The properties of the resulting turning tool made in accordance with the present invention are determined by a cutting process and compared with the properties of a known turning tool which differed from the turning tool of the present invention only in that it was not subjected to the heat and pressure treatment of the present invention. In the cutting process, a C53N steel was face-cut with a face milling cutter of 125 mm diameter. The cutting speed $v$ was 88 m/minute, the cutting depth $a$ was 3 mm, and the advance $s$ was 0.4 – 1.0 mm/revolution. The known turning tool was able to produce 445mm of cutting length and then was no longer capable of cutting. The turning tool according to the present invention was able to produce 5,600 mm of cutting length and was still capable of cutting. The performance results demonstrated by Examples 1 and 2 show that the present invention is surprisingly very successful.

It will be understood that the above description of the present invention is susceptible to various modifications, changes and adaptations, and the same are intended to be comprehended within the meaning and range of equivalents of the appended claims.

What is claimed is:

1. A wear-resistant hard metal body comprised of (1) a core of hard metal body of at least one binder metal of iron, cobalt and nickel and at least one carbide of the elements titanium, zirconium, hafnium, vanadium, niobium, tantalum, chromium, molybdenum and tungsten, and (2) a surface coating of a hard material on the core, the hard material being at least one carbide, nitride, boride or oxide, and the surface coating containing a binder metal contained in the core of hard metal body and originating from the core of hard metal body.

2. The hard metal body as defined in claim 1 wherein the concentration of the binder metal in the surface coating decreases from the inside of the coating toward the outside of the coating.

3. The hard metal body as defined in claim 1 wherein the concentration of the binder metal in the surface coating is constant.

4. The hard metal body as defined in claim 1 wherein the binder metal is cobalt.

5. The hard metal body as defined in claim 1 wherein the hard material of the surface coating is TiC.

6. A wear-resistant hard metal body comprised of (1) a core of hard metal body made from at least one of the binder metals iron, cobalt and nickel and at least one of the carbides of the elements titanium, zirconium, hafnium, vanadium, niobium, tantalum, chromium, molybdenum and tungsten; (2) a surface coating of a hard material on the core, the hard material being at least one carbide, nitride, boride or oxide; and (3) at least one intermediate layer between the core and surface coating, said intermediate layer containing at least one of the binder metals iron, cobalt and nickel, and the surface coating containing at least one of the binder metals that is contained in the intermediate layer and originating from the intermediate layer.

7. The hard metal body as defined in claim 6 wherein the surface coating additionally contains at least one metal binder that originates from the core.

8. The hard metal body as defined in claim 6 wherein the concentration of the binder metal in the surface coating decreases from the inside of the coating toward the outside of the coating.

9. the hard metal body as defined in claim 6 wherein the concentration of the binder metal in the surface coating is constant.

10. The hard metal body as defined in claim 6 wherein the binder metal is cobalt.

11. The hard metal body as defined in claim 6 wherein the hard material of the surface coating is TiC.

12. A method for producing a wear-resistant hard metal body comprising subjecting a hard metal body, comprised of (1) a core of a hard metal body made from at least one of the binder metals iron, cobalt and nickel and at least one of the corbides of the elements titanium, zirconium, hafnium, vanadium, niobium, tantalum, chromium, molybdenum, and tungsten and (2) a surface coating of a hard material on the core, the hard material being at least one carbide, nitride, boride or oxide, for a period of time between about one minute and about 8 hours, to a pressure of between about $10^{-5}$ Torr and 10 bar, and a temperature between about 900° and about 1600° C to diffuse at least one binder metal from the core into the surface coating.

13. Method as defined in claim 12 wherein the pressure-temperature treatment of the hard metal body is effected in the presence of an inert protective gas.

14. The method as defined in claim 13 wherein the inert protective gas is hydrogen, nitrogen, helium or argon.

15. The method as defined in claim 12 wherein the time is between about one minute and 60 minutes, the pressure is between about $10^{-3}$ Torr to 10 Torr and the temperature is between about 1200° and about 1400° C.

16. The method as defined in claim 12 wherein the hard material is TiC and the binder metal is cobalt.

17. The method as defined in claim 12 wherein the pressure-temperature treatment brings about a concentration of binder metal in the surface coating which decreases from the inside of the surface coating toward the outside of the surface coating.

18. The method as defined in claim 12 wherein the pressure-temperature treatment brings about a uniform concentration of a binder metal in the surface coating.

19. A method for producing a wear-resistant hard metal body comprising subjecting a hard metal body, comprised of (1) a core of a hard metal body containing at least one of the binder metals iron, cobalt and nickel and at least one of the carbides of the elements titanium, zirconium, hafnium, vanadium, niobium, tantalum, chromium, molybdenum and tungsten; (2) a surface coating of a hard material on the core, the hard material being at least one carbide, nitride, boride or oxide; and (3) at least one intermediate layer between the core and the surface coating, said intermediate layer containing at least one of the binder metals iron, cobalt and nickel, for a period of time between about one minute and about 8 hours, to a pressure of between about $10^{-5}$ Torr and about 10 bar, and a temperature between about 900° and about 1600 c to diffuse at least one binder metal from the intermediate layer into the surface coating.

20. Method as defined in claim 19 wherein the pressure-temperature treatment of the hard metal body is effected in the presence of an inert protective gas.

21. The method as defined in claim 20 wherein the inert protective gas is hydrogen, nitrogen, helium or argon.

22. The method as defined in claim 19 wherein the time is between about one minute and 60 minutes, the pressure is between about $10^{-3}$ Torr to 10 Torr and the temperature is between about 1200° and about 1400° C.

23. The method as defined in claim 19 wherein the hard material is TiC and the binder metal is cobalt.

24. The method as defined in claim 19 wherein the pressure-temperature treatment brings about a concentration of binder metal in the surface coating which decreases from the inside of the surface coating toward the outside of the surface coating.

25. The method as defined in claim 19 wherein the pressure-temperature treatment brings about a uniform concentration of the binder metal in the surface coating..

26. The method as defined in claim 19 wherein the pressure-temperature treatment causes at least one binder metal from the core to diffuse into the surface coating.

* * * * *